US006320972B1

(12) United States Patent
Goller

(10) Patent No.: US 6,320,972 B1
(45) Date of Patent: Nov. 20, 2001

(54) LOUDSPEAKER

(75) Inventor: Lars Goller, Herning (DK)

(73) Assignee: Vifa-Speak A/S, Videbaek (DK)

( * ) Notice: Subject to any disclaimer, the term of this patent is extended or adjusted under 35 U.S.C. 154(b) by 0 days.

(21) Appl. No.: 09/505,992

(22) Filed: Feb. 17, 2000

(30) Foreign Application Priority Data

Feb. 17, 1999 (DK) ..... 1999 00213

(51) Int. Cl.[7] ..... H04R 25/00

(52) U.S. Cl. ..... 381/430; 381/423; 381/337; 381/343

(58) Field of Search ..... 381/337, 339, 381/340, 341, 343, 396, 423, 424, 430, FOR 143, FOR 162; 181/152, 156

(56) References Cited

U.S. PATENT DOCUMENTS 5,537,481 * 7/1996 Voishvillo et al. ..... 381/396

5,875,252 * 2/1999 Lesage ..... 381/423

* cited by examiner

*Primary Examiner*—Huyen Le

(74) *Attorney, Agent, or Firm*—Nixon Peabody LLP; David S. Safran

(57) ABSTRACT

A special Hi-Fi tweeter having a ring-shaped dome portion with a retracted central portion fixed to the tweeter chassis was found to present an objectionable drop of response in the 18–20 KHz range. According to the invention this problem is eliminated or minimized in placing in front of said central area a forwardly projecting, generally conical wave guide (18) that will minimize interferences between sound waves radiated forwardly and inwardly from the ring shaped dome. An alternative solution is to arrange, in front of a wider central portion, a shield member directly preventing external radiation from the critical central area, still without changing the shape of the diaphragm. However, also certain modifications are proposed, which may well be used in connection with ordinary dome speakers.

9 Claims, 2 Drawing Sheets

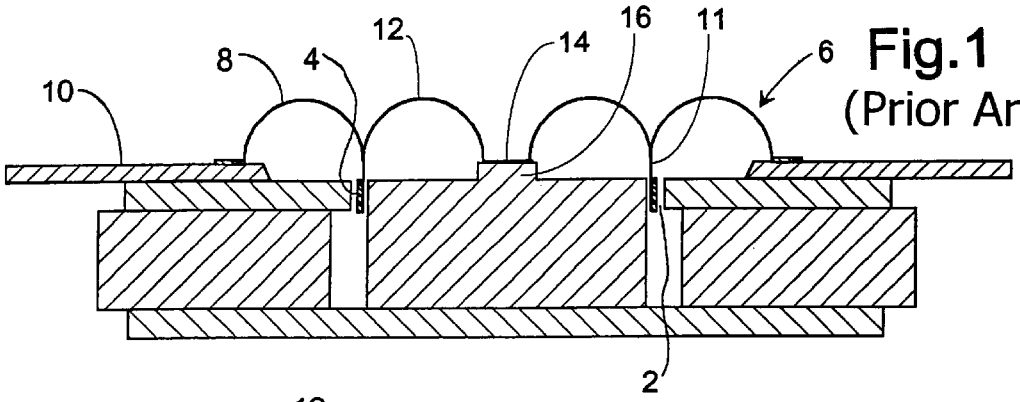
Fig.1
(Prior Art)
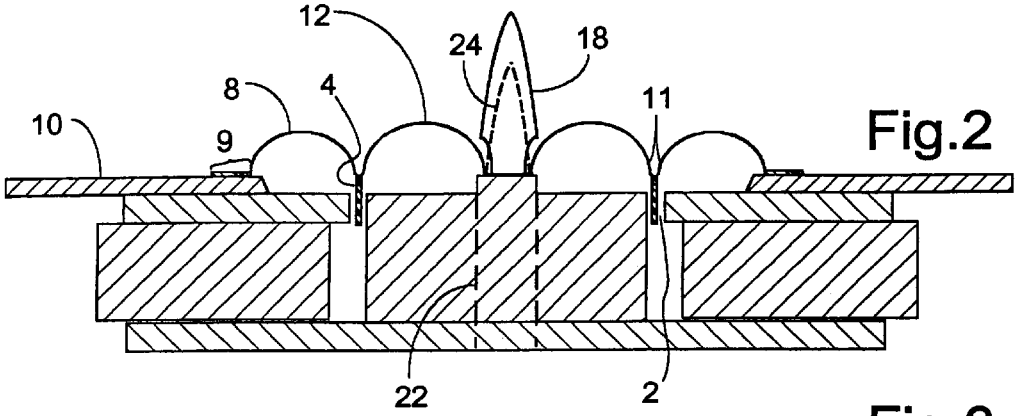
Fig.2
Fig.3
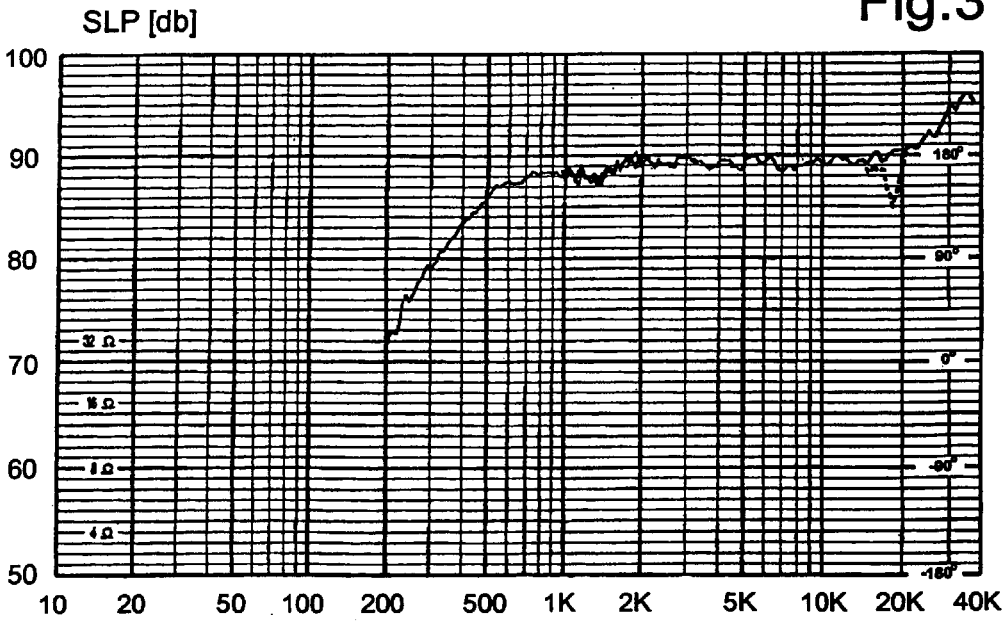

LOUDSPEAKER

The present invention relates to a loudspeaker of the special type which is disclosed in the publically accessible Danish Patent Application No. 1162/85, and which is illustrated in FIG. 1 of the present drawing. The speaker has a conventional magnet system with an annular air gap 2 for a voice coil 4 connected to a loudspeaker diaphragm generally designated 6. The construction is comparable to a so-called dome speaker, having an annular edge suspension 8 of half circular cross section connecting the voice coil 4 with a surrounding chassis portion 10, and normally having the voice coil connected with a forwardly projecting, central dome; the difference is that in this particular speaker the dome is replaced by a "ring dome" 12 having a retracted central, flat portion 14 which is rigidly secured to a central portion 16 of the fixed structure.

It was found that in several respects such a-loudspeaker is highly suited for highquality sound reproduction, in particular due to a good suppression of higher harmonic of distortion products and almost total avoidance of resonances in the audible frequency range. The functional main difference from a conventional dome speaker is that the central ring dome 12 will act as a rolling membrane rather than as a piston element, while also the relatively large suspension portion 8, acting in a similar manner, will contribute pronouncedly to the sound reproduction.

It was also found, however, that the speaker had one weak point, viz. a clearly measurable efficiency reduction in the highermost frequency range, typically in the 18–20 KHz range. Many listeners would not notice this, but in connection with Hi-Fi equipment the purely technical measurements of the transfer function are highly decisive.

Further experiments in the applicant's laboratories resulted in various improvements, some of which will be disclosed in the present case, but the said weak point still existed. It was a major breakthrough, therefore, when it was realized and demonstrated that the associated problem could be solved in a manner not even affecting the design of the diaphragm, viz. by adding a generally conical, rigid wave guide member to the loudspeaker structure just in front of the said retracted and fixed central portion of the ring dome portion.

This solution was based on an assumption of the problem being due to interferences of the sound waves in the innermost area in front of the said central area, where the "rolling membrane" movements of the interfacing surfaces of the ring dome portion 12 will give rise to vividly intersecting radiations of sound waves in that area, and if this could be avoided or minimized by positively guiding the inwardly directed waves less inwardly and more forwardly, then this could perhaps reduce the problem. In view of all of the previous experiments it was surprisingly found that this measure was indeed a key to a solution of the problem. Even highly sensitive measurements confirmed that the said critical efficiency drop in the higher frequency range disappeared completely and that no additional drawbacks were introduced.

It was then also realized that the problem could be solved in a modified manner, viz. by providing a regular shield in front of the critical area, which is the area inside the annular top of the ring dome 12. The tweeters in question will typically be quite small, e.g. with a total diaphragm diameter of less than 10 cm and even less than 5 cm, and the central area thus shielded off will not contribute significantly to the effect of the loudspeaker.

Hereafter, the invention will be described in more detail with reference to the drawing, in which:

FIG. 1 is a cross sectional view of an already known and already discussed loudspeaker, FIG. 2 is a corresponding view of a loudspeaker according to the present invention, and FIG. 3 is a frequency response diagram referring to the transfer function of both of these loudspeakers.

Figure 4:
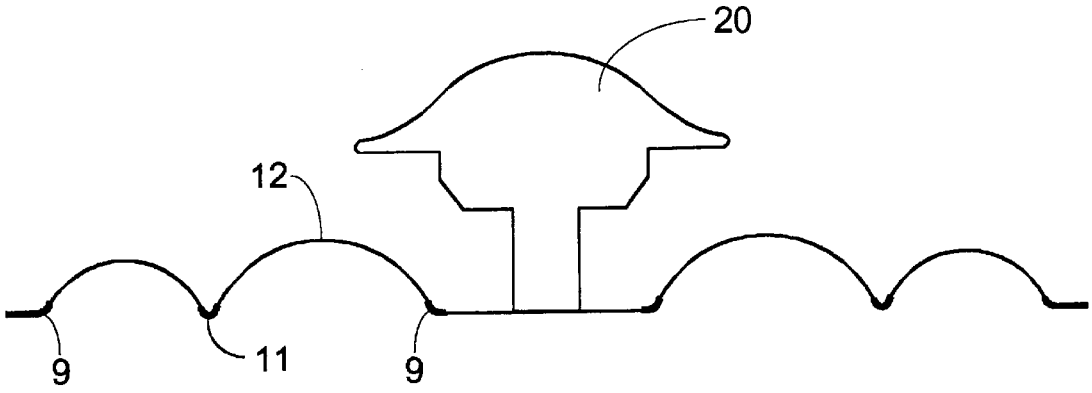
FIG. 4 is a sectional lateral view of a diaphragm in association with a modified guide member.

In view of the explanation already given with reference to FIG. 1 it will be easy to see that the basic construction of the chassis, magnet and diaphragm system of FIG. 2 is or may be exactly the same as in FIG. 1.

What is characterized for FIG. 2 is that in front of the central portion 14,16 there is provided a forwardly projecting wave guide element is having a forwardly pointed shape. The root portion of this element is narrowed so as to not interfere with the operational movements of the innermost wall portions of the annular dome 12.

Based on the finding according to the invention it will be readily understood that sound waves emitted from the said innermost wall portions will not be radiated so as to be immediately intercrossing, as they will be deflected to pass out along the surface of the guide element 18 and ultimately be outwardly merged, at the tip of the element 18, with highly uniform wave propagation direction.

FIG. 3 illustrates the transfer function of a tweeter made both with and without the provision of the wave guide 18. Without the wave guide 18 there is a clear efficiency drop in the frequency range 18–20 KHz as shown by a dotted curve line, while this drop is totally eliminated when the wave guide 18 is added.

Of course, it would be desirable to specify dimension limitations of the wave guide 18, but it has not yet been ascertained to what degree the dimensions may be varied. The width of the central portion 14 should not be more than half the width of the voice coil 4, preferably only ⅓ to ⅕ thereof. As far as the entire diaphragm is concerned, FIG. 2 is magnified authentic representation of the loudspeaker used for the measurement according to FIG. 3, the real exterior diameter of the entire diaphragm being 38 mm.

In FIG. 2 it is indicated in dotted lines that the fixed portion, to which the central diaphragm area 14 is secured, may be a rod 22 projecting through a central channel in the central element of the magnet system, so as to be a part of the chassis rather than of the magnetic system itself.

As an extreme possibility it should be mentioned that the wave guide member 18 could be held in place by an external. holding structure, e.g. a carrier bar of the chassis extending diagonally over the exposed side of the diaphragm. In that case the guide member should not necessarily have any narrowed root portion, as it would not need to contact the central areas 14,16.

The said narrow root portion of the member 18 will be of particular relevance when the cross section of the inner dome ring 12 exhibits a more or less half-circular shape of the dome as in FIG. 1, while when this shape is less than half-circular as in FIG. 2 it can be perfectly possible, as shown in dot-and-dash lines 24 in FIG. 2, that the member 18 may be shaped without any narrowed root portion, as in this case the member 18 may contact the central area 14,16 all over the innermost width of the broader basis of the member 18 without in any way limiting the oscillations of the innermost wall of the ring dome structure.

There is a further and significant difference between FIG. 1 and FIG. 2, viz. in the manner in which the diaphragm is secured to the voice coil. In FIG. 1 the retracted annular area, designated 11, between the annular diaphragm portions 8 and 12 is fixed to the inner surface of the outer end of the voice coil 4, corresponding to the conventional manner of fixing the diaphragm in ordinary dome speakers, where the portion 8 is a narrower edge suspension part. In FIG. 2 it will be noted that this fixing is effected not at the side, but at the end of the voice coil. This brings about a closer and firmer contact between the parts, and it has been found to contribute surprisingly to a correct transfer function and a high efficiency. It is believed, therefore, that this type of fixation will be highly advantageous even in ordinary dome speakers, particularly those with domes of soft materials. It offers to the diaphragm designer the advantage that the geometry of the connection will be given by the shape of the diaphragm itself and not additionally by the adhesive used for the fixation.

In connection with dome speaker constructions there are different sets of advantages and disadvantages of using diaphragms of soft and hard materials, respectively. With the present invention it has been found to be an interesting and promising possibility to make use of a combination of such materials, in particular with respect to using a hard, metallic material for the majority of the area portions of the dome or ring-dome sections and softer materials for the portions adjacent to the fixation zones of the diaphragm, i.e. here the innermost area 11 and the peripheral area as designated 9 in FIG. 2. Also at these junctions it will be preferential to join the meeting sheet materials edge-to-edge rather is that side-to-side. The resulting advantage is deemed to be important even in connection with ordinary dome speakers.

Ideally the wave guide 18 should project rather far forwardly, but in practice it has been found that it is sufficient if it projects some 10 mm out from the basis of the diaphragm or some 2–6 times the elevation of the central ring-dome section 12. The absolute criterion is that the wave guide member should prevent or minimize interferences between the sound waves radiated towards the central space in front of the innermost section of the ring dome 12.

As already mentioned, a well usable alternative for the wave guide member 18 is a shield element in front of the central area inside the annular top line of the ring dome 12, a pertinent example being shown in FIG. 4, where the guide member is substituted by a mushroom-like member 20, the hat portion of which having a diameter slightly less than the diameter of said annular top line. For optimizing the transfer function in general, the detailed shape of the member should be subjected to detailed studies and experiments, but in the present connection it is sufficient to note that the member 20 will effectively prevent radiation of interferences between waves radiated forwardly and inwardly towards the said central space.

What is claimed is:

1. In a loudspeaker of the tweeter type having a chassis and a magnet system defining an annular air gap for a voice coil connected with a loudspeaker diaphragm, the loudspeaker diaphragm having an outermost diaphragm portion which interconnects the voice coil and the chassis that is an annular, arch-profiled strip area, and having a central ring-shaped central dome portion with a central recessed area that is rigidly fixed to one of the magnet system and the chassis; the improvement comprising an element effectively counteracting external radiation of interference sound waves emanating from waves radiated forwardly and inwardly from the ring-shaped dome portion being provided in front of said central recessed area.

2. A loudspeaker according to claim 1, wherein said central dome portion has a substantially semicircular cross section.

3. A loudspeaker according to claim 1, wherein said element is a forwardly projecting, generally conical wave guide member which diverges the forwardly and inwardly radiated waves generally only forwardly.

4. A loudspeaker according to claim 3, wherein the wave guide member projects a distance from said central area which is at least twice the height dimension of the ring-shaped dome portion.

5. A loudspeaker according to claim 3, wherein a largest width of the wave guide member is less than half of the diameter of the voice coil.

6. A loudspeaker according to claim 1, wherein said element is a shield member arranged to hold back external radiation emanating from inner sides of the ring-shaped dome portion.

7. A loudspeaker according to claim 6, wherein said shield member is generally mushroom-shaped.

8. A loudspeaker according to claim 1, wherein the arch-profiled strip area and an outer edge of the ring-shaped dome portion have a meeting area which is secured to the voice coil by being bonded to a transverse end edge surface of the voice coil.

9. A loudspeaker according to claim 1, wherein at least one of the arch-profiled strip area and the ring-shaped dome portion is made of a generally hard diaphragm material that is least one of its edges to a soft and flexible diaphragm material that is connected to at least one of the voice coil and loudspeaker chassis.

* * * * *